US005907114A

United States Patent [19]

Culver

[11] Patent Number: 5,907,114

[45] Date of Patent: May 25, 1999

[54] VIBRATO DEVICE FOR ELECTRIC GUITAR

[76] Inventor: Curtis S. Culver, 1212 Chesnut, Tarkio, Mo. 64491

[21] Appl. No.: 08/888,483

[22] Filed: Jul. 7, 1997

[51] Int. Cl.[6] ..... G10D 3/00

[52] U.S. Cl. ..... 84/313

[58] Field of Search ..... 84/313

[56] References Cited

U.S. PATENT DOCUMENTS 4,137,812 2/1979 Franzmann ..... 84/313

4,317,403 3/1982 Franzmann ..... 84/313

*Primary Examiner*—William M. Shoop, Jr.

*Assistant Examiner*—Shih-yung Hsich

*Attorney, Agent, or Firm*—J. David Wharton Shook, Hardy & Bacon

[57] ABSTRACT

An improved vibrato device for an electric guitar that includes a lever passing from the bridge assembly down through the guitar body front surface and extending toward the neck and then upwardly through the guitar front surface within convenient reach of a musician's picking hand. The lever may be operatively coupled with a controller that enables the musician to better synchronize the vibrato effect during playing with other desired effects, such as volume changes, phase changes and effects produced by Musical Instrument Digital Instrument (MIDI) devices.

6 Claims, 2 Drawing Sheets

Fig.5.
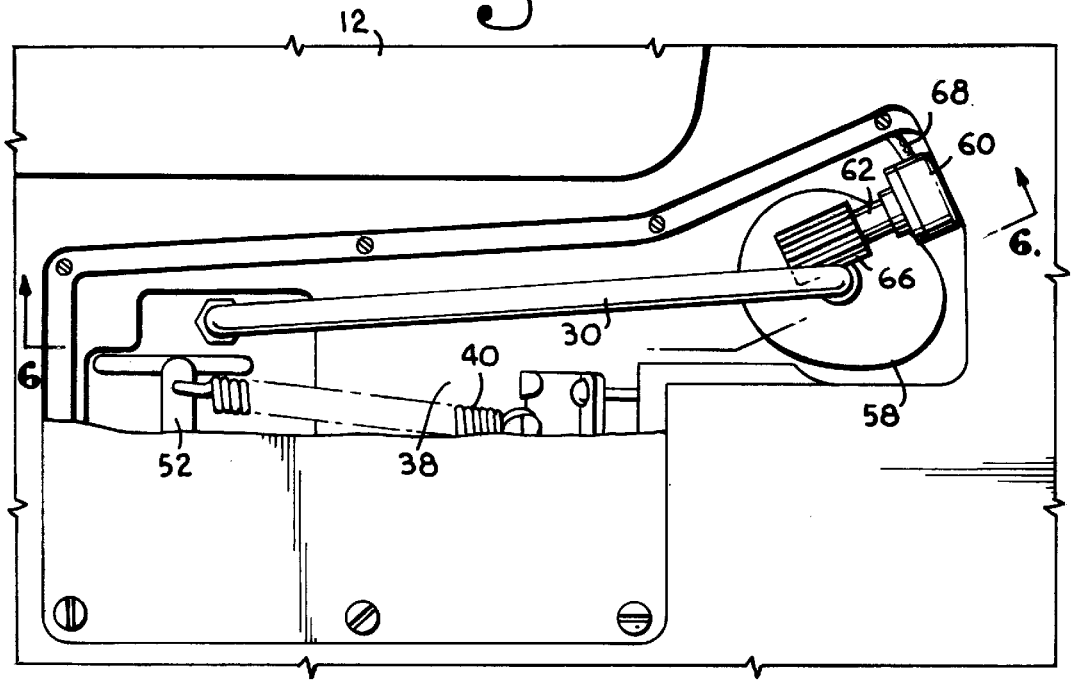
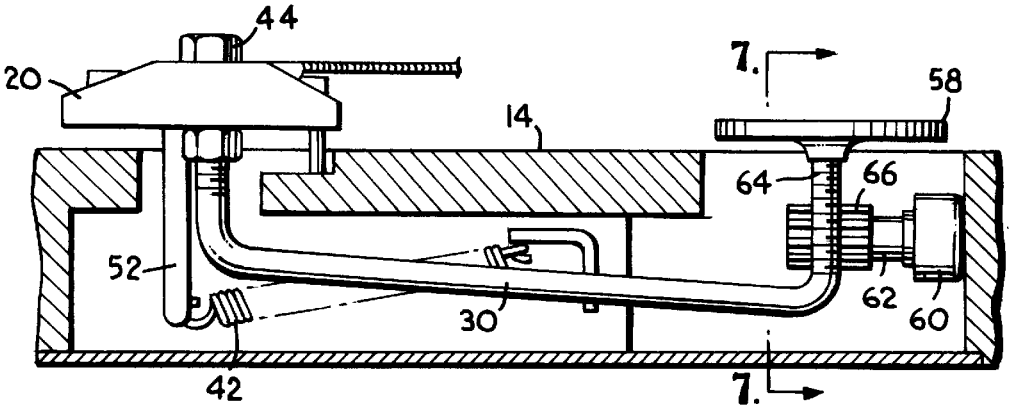
Fig.6.
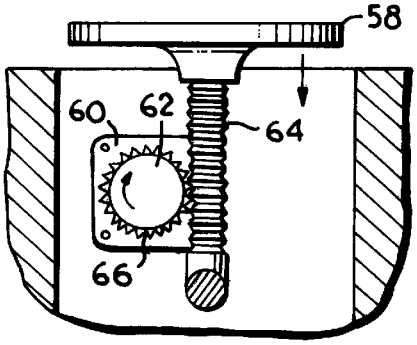
Fig.7.

VIBRATO DEVICE FOR ELECTRIC GUITAR

BACKGROUND OF INVENTION

This invention relates to the field of musical instruments and, more particularly, to a vibrato device for an electric guitar.

Musicians have long known to impart a desirable "vibrato" effect to musical notes by slightly varying the pitch of the note as it sounded. This effect is highly desirable to listeners of stringed instruments. On fretless stringed instruments, such as violins, the musician typically imparts vibrato by holding a string against the neck of the instrument and rocking the finger holding the string back and forth along the longitudinal axis of the string as the string is played. The speaking length of the string, and thus the pitch, are thereby varied at a desired rate to produce vibrato.

On fretted stringed instruments, such as electric guitars, different techniques have been necessary to impart vibrato. It is known to vary the pitch of a note by holding a string against the neck of the guitar with a finger and moving the string back and forth along the length of the fret as the string is played. However, this method has limitations. Achieving a desired vibrato effect in this way can be more difficult for the musician compared with fretless stringed instruments. Moreover, by moving the strings repeatedly in a direction perpendicular to their longitudinal axis, tunings could be more frequently required. This method could also be more difficult if the musician were holding multiple strings against the neck of the guitar, such as when playing a chord.

To overcome the difficulties of imparting vibrato to notes played on the electric guitar, mechanical vibrato devices have been developed. As known to those skilled in the art, such vibrato devices generally consist of a bridge assembly for holding the strings that is adapted to pivot continuously between two positions and thereby to vary the pitch of the strings. The vibrato device is typically biased to one position by springs. A vibrato hand lever extending above the guitar front surface is normally coupled with the vibrato device, which is then actuated by depressing the vibrato lever. In operation, a guitar musician plays the desired notes with the playing hand and then moves the playing hand away from the strings to grasp and actuate the vibrato lever. The lever is normally pivotally coupled with the vibrato device to enable the lever to swing out of the way when not in use.

The typical vibrato device can limit a guitar player's ability to impart vibrato. The vibrato lever must often be first rotated into an operable position prior to use, which can undesirably impede playing. The orientation of the conventional vibrato lever, extending upwardly and outwardly from the front surface of the guitar, also makes it difficult to quickly impart vibrato without maintaining a constant hold of the lever and, in some instances, partially depressing it. However, maintaining a constant hold of the lever can interfere undesirably with playing. The same is true for maintaining the lever in a slightly depressed position. In both instances, the movement of the picking hand can be undesirably constrained. For example, a musician often wishes to play certain strings of the guitar while muting others with the palm of the picking hand. As known to those skilled in the art, such muting can be necessary to prevent the strings not played from producing unwanted ringing when the guitar is played through an electric amplifier. Imparting vibrato during such "pick and mute" playing can be particularly awkward, if not impossible, with a conventional vibrato device because the conventional lever may prevent the musician from properly muting the desired strings. Additionally, as known to those skilled in the art, striking the vibrato lever can impart a desirable "warble" to the sound of the strings, an effect commonly used in hard rock music. Striking the vibrato bar presently requires the musician to undesirably move the hand away from the strings, rendering simultaneous "pick and mute" playing nearly impossible.

Additionally, it can be desirable to vary by electronic means the sound produced by the strings of an electric guitar. A volume control, typically comprising a potentiometer, may be provided in the magnetic pickup circuit for the strings. Such a volume control is normally located on the front surface of the guitar. In addition, the electric guitar may be connected to an amplifier through a controller, such as the well-known "wah-wah" pedal. The controller can be actuated by the player's foot and may be configured to vary the volume, the phase or other properties of the sound produced by the strings.

A musician's use of such controllers during playing is subject to limitations. Rotating a potentiometer by hand to a desired volume setting without interrupting play is difficult. Similarly, foot-operated controllers typically cannot be actuated with a high degree of precision. Thus, at present, it is difficult to accurately synchronize the vibrato imparted by a vibrato device with effects imparted by a controller.

To overcome these and other limitations of the prior art, an improved vibrato device for an electric guitar is desirable to allow the musician to more easily impart vibrato and other effects to music played thereon.

SUMMARY OF THE INVENTION

Accordingly, it is an object of the present invention to provide an improved vibrato device for an electric guitar that is more easily actuated by the musician than prior such devices. A related object is to permit the musician to actuate the vibrato device without significantly moving the playing hand away from the strings. Another related object is to permit the musician to quickly and repeatedly actuate the vibrato device without having to maintain constant contact with the vibrato lever. A further related object is to provide a vibrato device requiring less actuation force, thereby enabling a broader range of control over the vibrato effect produced.

Another important object of the invention to provide an improved vibrato device for an electric guitar that does not require modification of existing guitar body shapes.

Yet a further important object of the invention is to provide a controller that can be actuated by a hand-operated vibrato device for an electric guitar. A related object is to permit the musician to impart desired effects to the music played on the guitar in synchronization with the vibrato effect imparted by the vibrato device.

According to the present invention, the foregoing and other objects are obtained by providing an electric guitar with a conventional vibrato means, such as a pivoting bridge assembly that is spring-biased to a desired at-rest position. The vibrato means is then provided with a lever having a first section, a second section and a third section. The first section and the second section are coupled with one another as are the second and third sections. The first section of the lever has a first end that is coupled with the vibrato means and extends downwardly therefrom through an aperture in the front surface of the guitar and typically into a cavity in the guitar body. The second section extends at a substantially 90-degree angle away from the first section and substantially parallel to the front surface in the spring cavity. The third section extends at a substantially 90-degree angle away from the second section and upwardly through the guitar body to terminate in a second end that extends above the front surface of the guitar. The second end is preferably supplied with a finger pad presenting an enlarged flat surface for ease of use. During operation, the musician may actuate the vibrato device by depressing the second end of the lever in a desired manner to achieve a vibrato effect.

Additionally, the electric guitar may be supplied with a controller, such as a potentiometer, optical encoder or voltage controller, that is operably coupled with the lever. During operation, when the musician actuates the vibrato device by depressing the vibrato lever, the controller likewise varies in a desired manner to produce effects, such as a volume change, phase change or other special sounds, while vibrato is imparted. The controller may be in the same circuit as the string pickups or may be in a separate circuit.

Additional objects, advantages and novel features of the invention will be set forth in part in the description which follows, and in part will become apparent in those skilled in the art upon examination of the following, or may be learned by practice of the invention.

BRIEF DESCRIPTION OF THE DRAWING

In the accompanying drawings, which form a part of this specification, which are to be read in conjunction therewith and in which like reference numerals are used to indicate like parts in the various views:

FIG. 5 is a perspective view of an alternative embodiment of the present invention similar to FIG. 4, but showing a controller and an alternative finger pad.

FIG. 6 is an enlarged cross-sectional view of an alternative embodiment of the present invention taken along line 6—6 in FIG. 5 with part of the guitar body being broken away to show particular details of construction.

FIG. 7 is an enlarged cross-sectional view taken along line 7—7 in FIG. 6 showing particular details of construction of an alternative embodiment of the present invention.

DETAILED DESCRIPTION OF THE PREFERRED EMBODIMENT

Figure 1:
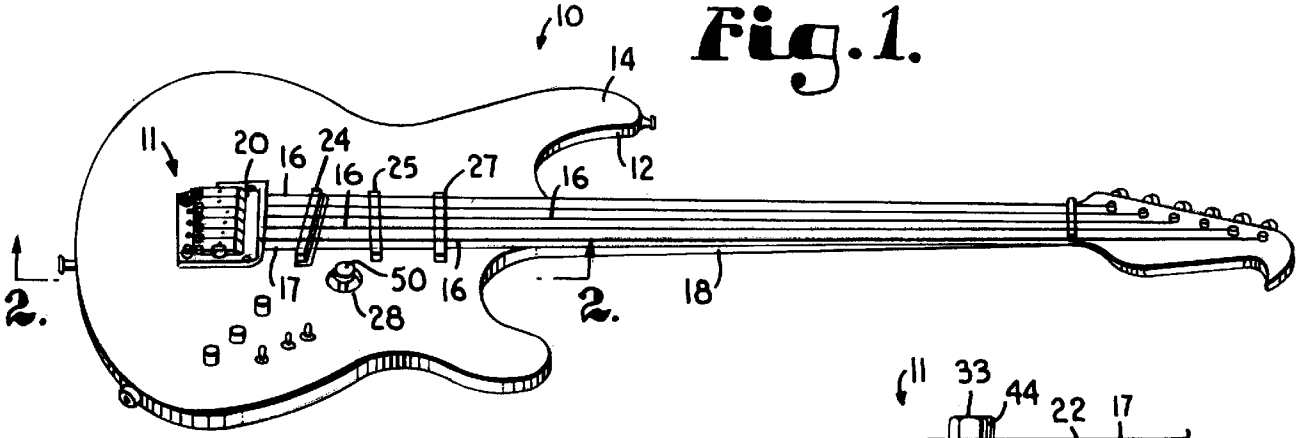
FIG. 1 is a perspective view showing the present invention coupled with an electric guitar.
Figure 2:
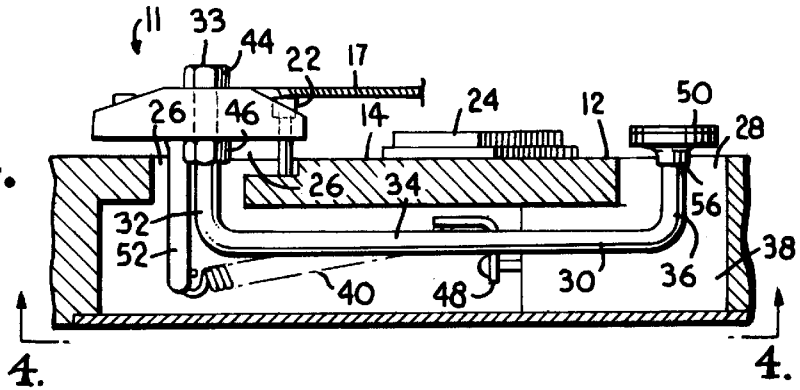
FIG. 2 is an enlarged cross-sectional view taken along line 2—2 in FIG. 1 with part of the guitar body being broken away to show particular details of the construction.

A vibrato device of the present invention is shown in FIGS. 1 and 2 designated generally by 11. As shown in FIG. 1, an electric guitar 10 is comprised of a neck 18, magnetic pickups 24, 25 and 27 and a body 12 having a front surface 14. Extending along front surface 14 and neck 18 are strings 16 and 17. A bridge assembly 20 is coupled with front surface 14 by pivot supports 22 and 23. Strings 16 and 17 are secured to bridge assembly 20. As known to those skilled in the art, the pivot supports permit bridge assembly 20 to move continuously between two positions and in so doing to vary the tension in strings 16 and 17, causing their pitch to vary during playing.

Figure 4:
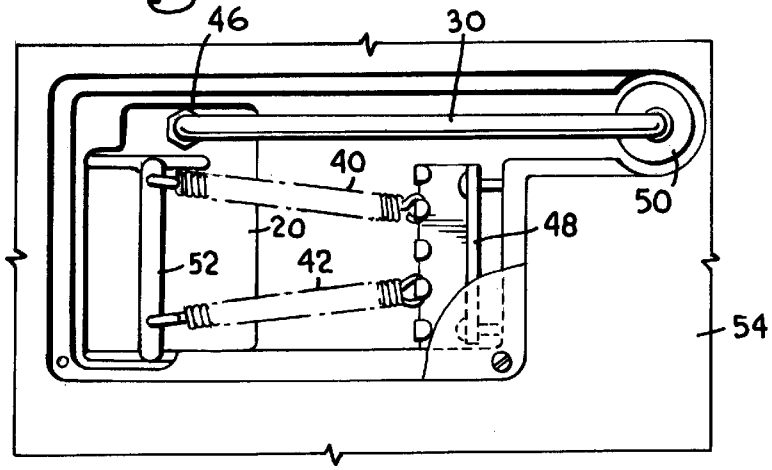
FIG. 4 is a perspective view of the present invention from the rear surface of the electric guitar shown in FIG. 1.

A bracket 52 extends downwardly from bridge assembly 20 through an aperture 26 in body 12 and into a spring cavity 38 underneath front surface 14. A bracket 48 is disposed within spring cavity 38. As shown in FIG. 4, springs 40 and 42 are coupled with brackets 52 and 48 to bias bridge assembly 20 to a desired at-rest position. Bridge assembly 20, bracket 52, bracket 48 and springs 40 and 42 comprise a vibrato means for an electric guitar that will be known to those skilled in the art. Other vibrato means are well known to those skilled in the art, such as those sold by the Gibson or the Fender guitar companies. For example, a floating vibrato means could be employed wherein the at-rest position of the vibrato means is approximately midway between its pivotal travel limits.

A lever 30 is provided that is comprised of a first section 32, a second section 34 and a third section 36. Lever 30 is preferably made of a rigid material, such as aluminum or steel, but a strong plastic or composite material could also be successfully employed. Lever 30 is further comprised of a first end 33 and a second end 56. As shown in FIG. 2, first end 33 extends through bridge assembly 20 and is secured thereto by nuts 44 and 46. Other means of securing lever 30 to bridge assembly 20, such as by means of a press-fit or snap ring, will be known to those skilled in the art and are contemplated by the present invention. First section 32 extends downwardly from bridge assembly 20 through aperture 26 toward a rear surface 54 of guitar body 12 and into spring cavity 38. Second section 34 extends preferably at a substantially 90-degree angle from first section 32 in spring cavity 38 in the general direction of neck 18 parallel to front surface 14. Third section 36 extends from second section 34 preferably at a substantially 90-degree angle and upwardly to extend above front surface 14 and to terminate in a second end 56 that extends above front surface 14 through an opening 28. Preferably, a finger pad 50 is disposed atop end 56 to further facilitate actuation of the vibrato device. An alternative, noncircular finger pad 58 may also be employed.

Figure 3:
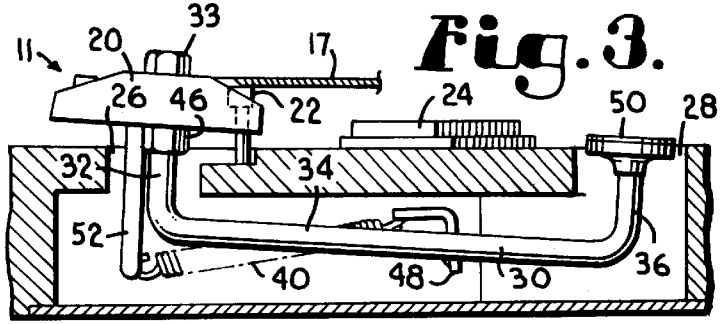
FIG. 3 is an enlarged cross-sectional view similar to FIG. 2, but showing the present invention in the actuated position.

FIG. 2 illustrates the device of the present invention held in an at-rest position by springs 40 and 42. FIG. 3 in contrast illustrates the vibrato device of the present invention after downward pressure has been applied to finger pad 50 to thereby depress and actuate the vibrato device. FIG. 4 illustrates a rear view of the present invention showing the shape of the spring cavity below rear surface 54. Alternatively, a floating vibrato means having an at-rest position approximately midway between its pivotal travel limits could be employed. With such a vibrato means, the player could pull or depress finger pad 50. Pulling finger pad 50 would raise the pitch of played notes, and depressing finger pad 50 would lower the pitch of played notes. In such an embodiment, it could be desirable to provide a recessed area in body 12 proximate the circumference of finger pad 50 to better facilitate access to finger pad 50 during pulling operations.

In operation, the electric guitar may be played as desired. Finger pad 50 can be easily depressed during play to impart a desired vibrato effect. This in turn causes bridge assembly 20 to pivot and thereby lessen the tension in strings 16 and 17, which in turn lowers the pitch of the strings. When lever 30 is released the vibrato device of the present invention returns toward the at-rest position as shown in FIG. 2, and the strings resume a higher pitch. The musician may depress and release the lever rapidly to achieve a desired effect without interrupting or impeding playing. By disposing the actuating lever for the vibrato device below the front surface of the guitar body and by enabling the musician to actuate the guitar device with a lever that extends slightly above the surface of the guitar adjacent the position of the picking hand, the present invention greatly increases the ability to impart vibrato and other desired effects while playing an electric guitar.

FIG. 5 illustrates a variation on the present invention wherein a controller 60 is provided preferably in spring cavity 38. The controller may be a potentiometer, an optical encoder, a voltage controller or similar device as will be appreciated by those skilled in the art. Controller 60 is preferably coupled with guitar body 12 and electrically coupled to the magnetic pickup circuitry for the strings by wires 68. Alternatively, controller 60 may be in a separate circuit. Extending from controller 60 is a shaft 62 provided with a gear 66. In this embodiment, all components of the vibrato device are identical to those previously described for vibrato device 11 with the exception of third section 136. Section 136 differs from the corresponding section 36 of vibrato device 11 in that it is provided with gear teeth 138 which mesh with the teeth of gear 66.

In operation, the musician depresses and releases finger pad 58 to impart a desired vibrato effect as previously described. When finger pad 58 is depressed teeth 138 cause gear 66 and shaft 62 to rotate and thereby to create a desired control signal that can be coupled with an electric amplifier or with another suitable device. For example, the controller could be used to control the volume as vibrato is being imparted to the strings. A synchronized volume swell could occur as the pitch of the notes is raised, or a synchronized volume decay could occur as the pitch of the notes is lowered. It will be appreciated that more complicated gearing arrangements may be provided to enhance the effect of a very small movement of third section 136. Synchronized phase changes and effects could likewise be directed by the controller.

From the foregoing, it will be seen that this invention is one well-adapted to obtain all of the ends and objects herein above set forth together with other advantages which are obvious and which are inherent to the structure. It will be understood that certain features and subcombinations are of utility and may be employed without reference to other features in subcombinations. For example, various lengths of the second section could be utilized to achieve a desired mechanical advantage. Additionally, a switch could be provided on the front surface of the guitar to electrically activate or deactivate the controller. Likewise, instead of being mechanically coupled with the vibrato lever, the controller could be optically coupled therewith. Additionally, a rotary-type potentiometer or other controller capable of more than one revolution could be employed to expand the finger pad travel distance. Such alternatives are contemplated by and within the scope of the claims. As many possible embodiments may be made of the invention without the departing from the scope thereof, it is to be understood that all matter herein set forth or shown in the accompanying drawings is to be interpreted as illustrative and not in a limiting sense.

I claim:

1. A vibrato device for an electric guitar having a neck, a body with a front surface, there being an opening in the front surface, a string pick-up on the front surface and strings extending along the neck and across the front surface and the string pick-up, comprising:

vibrato means for varying the tension in the strings to impart a vibrato effect to the sound emitted by the strings, said vibrato means being proximate the strings when coupled with the body; and a lever having a first section, a second section and a third section, said first and second sections and said second and third sections being coupled with one another, said first section having a first end coupled with said vibrato means and extending therefrom through the body of the guitar, said second section extending at substantially 90 degrees to said first section and substantially parallel to the front surface, and said third section extending at substantially 90 degrees to said second section, substantially parallel to said first section and upwardly through the body and terminating in a second end that extends through the opening and above the front surface.

2. The vibrato device of claim 1, further comprising a finger pad coupled with said second end.

3. The vibrato device of claim 1, further comprising a controller operatively coupled with said lever.

4. The vibrato device of claim 3, wherein said controller is electrically coupled with the string pick-up.

5. A vibrato device for an electric guitar having a neck, a body with a front surface, there being an opening in the front surface, a string pick-up on the front surface and strings extending along the neck and across the front surface of the string pick-up, comprising:

vibrato means for varying the tension in the strings to impart a vibrato effect to the sound emitted by the strings, said vibrato means being proximate the strings when coupled with the body;

a lever having a first section, a second section and a third section, said first and second sections and said second section and third sections being coupled with one another, said first section having a first end coupled with said vibrato means and extending therefrom through the body of the guitar, said second section extending at substantially 90 degrees to said first section and substantially parallel to the front surface, said third section extending at substantially 90 degrees to said second section, substantially parallel to said first section and upwardly through the body and terminating in a second end that extends through the opening and above the front surface, and said third section being provided with teeth;

a finger pad coupled with said second end; and a controller having a shaft and a gear coupled with said shaft, said controller being disposed to operatively engage said teeth of said third section.

6. The vibrato device of claim 5, wherein said controller is electrically coupled with the string pick-up.

* * * * *